US008345913B2

(12) United States Patent
Pang et al.

(10) Patent No.: US 8,345,913 B2
(45) Date of Patent: Jan. 1, 2013

(54) HEADPHONE WITH RESTRAINT AND METHODS

(76) Inventors: Jeffrey Pang, Menlo Park, CA (US); Caroline Pang, Menlo Park, CA (US); David Pang, Menlo Park, CA (US); Stephen Y. F. Pang, Menlo Park, CA (US)

( * ) Notice: Subject to any disclaimer, the term of this patent is extended or adjusted under 35 U.S.C. 154(b) by 8 days.

(21) Appl. No.: 13/133,842

(22) PCT Filed: Nov. 17, 2010

(86) PCT No.: PCT/US2010/057098

§ 371 (c)(1), (2), (4) Date: Jun. 9, 2011

(87) PCT Pub. No.: WO2012/067616

PCT Pub. Date: May 24, 2012

(65) Prior Publication Data

US 2012/0170790 A1 Jul. 5, 2012

(51) Int. Cl.
*H04R 1/10* (2006.01)

(52) U.S. Cl. ..... 381/384; 381/385

(58) Field of Classification Search ..... 381/384, 381/74, 370; 24/390
See application file for complete search history.

(56) References Cited

U.S. PATENT DOCUMENTS

| | | | | |
|---|---|---|---|---|
| 2009/0238395 | A1* | 9/2009 | Jubelirer et al. | 381/370 |
| 2010/0150370 | A1* | 6/2010 | Bales et al. | 381/74 |
| 2010/0170066 | A1* | 7/2010 | Honeycutt | 24/390 |
| 2011/0317865 | A1* | 12/2011 | Stevinson | 381/384 |

FOREIGN PATENT DOCUMENTS

| | | |
|---|---|---|
| KR | 20-1994-0023766 | 10/1994 |
| KR | 20-1997-011662 | 3/1997 |
| KR | 20-0156024 | 9/1999 |
| KR | 20-0157187 | 9/1999 |
| KR | 20-0181938 | 5/2000 |
| KR | 20-0272819 | 8/2002 |
| KR | 10-2005-0029659 A | 3/2005 |

OTHER PUBLICATIONS

International Search Report for application PCT/US2010/034445 filed on May 11, 2010.

Written Opinion of International Searching Authority for application PCT/US2010/034445 filed on May 11, 2010.

(Continued)

*Primary Examiner* — Yuwen Pan
*Assistant Examiner* — Phan Le
(74) *Attorney, Agent, or Firm* — Ogawa P.C.

(57) ABSTRACT

A headphone having reduced-tangling potential includes an audio plug for receive electrical signals from an audio device, coupled via wires to ear buds, wherein the ear buds are for receiving electrical signals and outputting audio, wires coupled to the audio plug and to the pair of ear buds, wherein the coupling wire is configured to provide the electrical signals from the audio plug to at least the pair of ear buds, and a restraint device having a pliable material body having an interior channel, wherein the channel restrains movement of the separate ear buds a first resistance, when the audio plug is inserted into the channel, and wherein the channel restrains movement the separate ear buds by a second resistance, when the audio portion is separated from the channel, wherein the first resistance amount exceeds the second resistance amount.

21 Claims, 5 Drawing Sheets

OTHER PUBLICATIONS

International Search Report for application PCT/US2010/057098 filed on Nov. 17, 2010.
Written Opinion of International Searching Authority for application PCT/US2010/057098 filed on Nov. 17, 2010.
Notice of Allowance for U.S. Appl. No. 12/777,819, dated Jul. 26, 2012.
Office Action and List of references by the examiner for U.S. Appl. No. 12/777,819, mailed May 24, 2012.

Kim, H.J., "Translation of Korean Publication No. 20-1997-011662", published on Mar. 29, 1997.

* cited by examiner

HEADPHONE WITH RESTRAINT AND METHODS

BACKGROUND OF THE INVENTION

Embodiments of the present invention relate to wired headphones capable of being stored in a configuration with reduced tangling tendency and methods thereof.

The inventors of the present invention have had many instances when they removed headphones (e.g. ear bud-type headphones) from a storage location (e.g. a pocket, a backpack), the headphones are tangled in a large mass of wires. In some instances, the inventors have had to spend minutes untangling a headphone cord before they can even use them. Accordingly, the inventors desired a headphone that had a reduced tendency to tangle.

Prior art techniques to solving the tangling problem have including using thicker headphone wire or insulation, but such techniques have drawbacks including that the headphone wires are stiff and do not easily move out of the users' way. Other techniques have included a wire pull between the wires leading to the ear buds, but such techniques have drawbacks including that such headphones still tangle and the pull often fails to keep the ear buds together. Other techniques have included an automatic spooling mechanism for the headphone wires, but such techniques have drawbacks including that the spooling mechanism is bulky, not aesthetically pleasing, and it causes a lot of stress on the wires. Other techniques have included winding the wires upon an object such as a piece of plastic or the user's fingers, which is a time consuming process. These problems especially significant with headphones with in-line microphones. The in-line microphone typically interferes with any winding or sliding mechanism because they are often bulky and they are rigid, not flexible.

A headphone having reduced storage tangling is thus desired.

BRIEF SUMMARY OF THE INVENTION

The present invention relates to wired headphones (including earphones, ear buds, or the like). More specifically, the present invention relates to wired headphones having the ability to be stored in a configuration with reduced-tangling tendency and methods thereof.

Various embodiments of the present invention include a headphone including one or more ear buds, an audio input jack, and a restraining mechanism. The restraint or restraining mechanism restrains relative movement of the ear buds relative to each other and the audio input jack. In various embodiments, the restraining mechanism is adapted to maintain a temporary loop in the headphone wires but can release the temporary loop in the headphone wires upon application of a relatively low amount of force, e.g. several pounds.

In operation, after the user removes her headphones, she grasps the restraint and repositions the restraint towards the ear buds (passing over a microphone, if present), and then inserts the audio input jack into the groove, slot, channel of the restraint, sometimes physically adjacent to the ear buds. The sliding resistance of the restraint with respect to the wires/input jack increases, when the audio input jack is inserted into the restraint.

In operation, a user retrieves the pair of headphones stored with the audio input jack being physically restrained to the one ear bud by a restraint mechanism. A process may include the user visually identifying the audio input jack and the restraint mechanism, grasping the audio input jack, and pulling the audio input jack away from the restraint such that tangles are reduced. The user inserts the audio input jack into an audio device and placing the at least one ear bud in a position proximate to a location of the user's ears.

According to one aspect of the invention, a headphone having reduced-tangling potential is described. A device includes an audio plug, a pair of ear buds, and headphone wires. One apparatus includes a restraint device coupled to the headphone wires, including a body comprising a pliable material, wherein the body includes a channel, wherein the channel is configured to restrain movement of a first ear bud with respect to a second ear bud by a first resistance amount, when at least a portion of the audio plug is inserted into the channel, and wherein the channel is configured to restrain movement the first ear bud with respect to the second ear bud by a second resistance amount, when the plug portion is separated from the channel, wherein the first resistance amount exceeds the second resistance amount.

According to another aspect of the invention, a restraint device for a headphone comprising an input plug coupled to a pair of ear buds via headphone wires, is described. One device includes a body comprising a pliable material, wherein the body includes an interior channel, wherein the headphone wires are disposed within the interior channel, wherein the interior channel is configured to restrain movement of a first ear bud with respect to a second ear bud, and to restrain movement of the first ear bud and second ear bud with respect to the input plug, when at least a portion of the input plug is inserted into the interior channel and when at least the portion of the input plug is adjacent to the headphone wires.

Additional objects, features and advantages of the present invention can be more fully appreciated with reference to the detailed description and drawings that follow.

BRIEF DESCRIPTION OF THE DRAWINGS

In order to more fully understand the present invention, reference is made to the accompanying drawings, that are not to be considered limitations in the scope of the invention. The described embodiments and the presently understood best mode are described with additional detail through use of the accompanying drawings in which.

DETAILED DESCRIPTION OF THE INVENTION

Figure 1A:
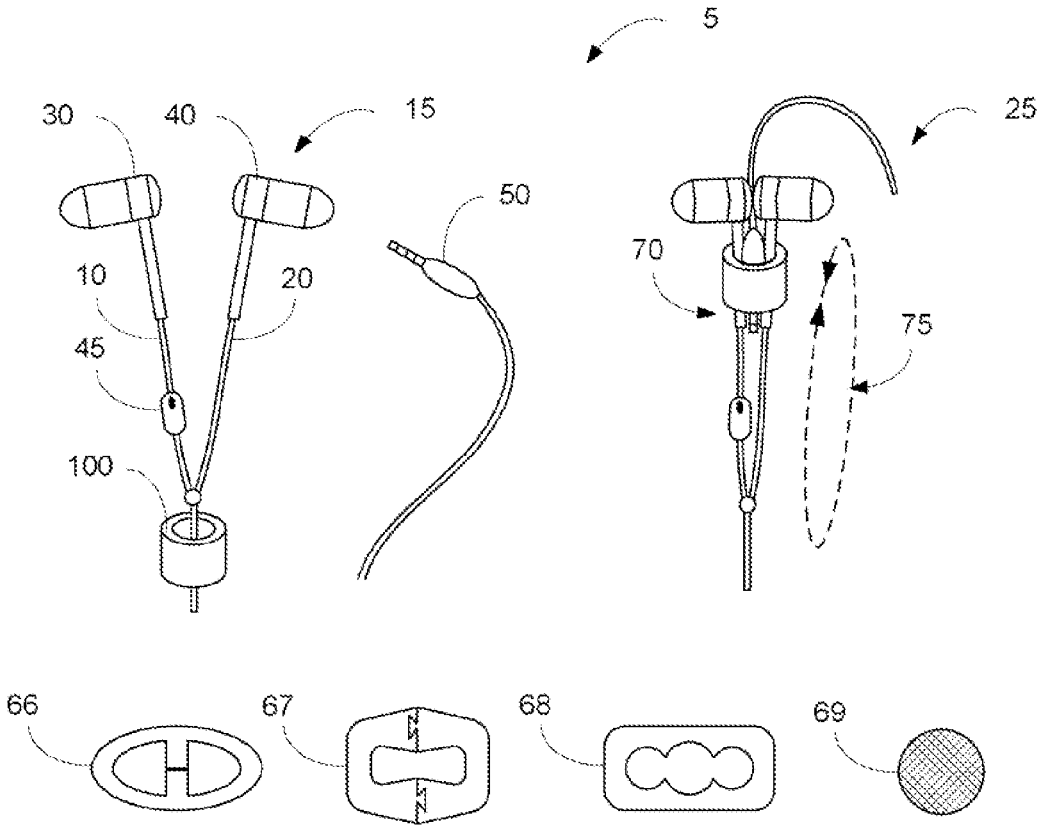
FIGS. 1A-B illustrate typical embodiments of the present invention.
Figure 1B:
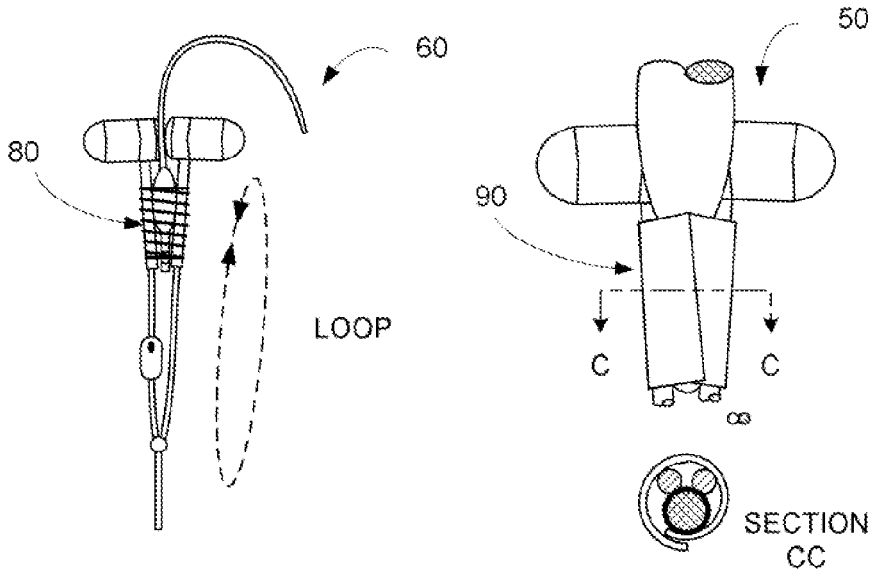

FIGS. 1A-B illustrates embodiments of the present invention. FIG. 1A illustrates a pair of earphones (ear buds) 5 in different configurations. As illustrated, ear buds 5 typically include ear buds 30 and 40 (that are typically inserted or placed upon a user's ears to provide audio outputs), an audio input (output) 50 (that is inserted into an audio device for receiving electrical outputs), wires 10 and 20 (coupling ear buds 30 and 40 to audio input 50), and (optionally) an in-line microphone 45 (that receives audio input from the user and provides it to the audio input/output 50). In various embodiments, in-line microphone 45 may include additional functionality such as volume buttons, control buttons, or the like.

In various embodiments, while in configuration 15, restraint 100 is positioned away from ear buds 30 and 40, and does not appreciably restrain ear buds 30 and 40 or audio input 50 with respect to each other. Thus, the user may freely plug in ear buds 30 and 40 into their ears, audio input 50 into their audio device, and listen to audio (e.g. music, speech).

In configuration 25, restraint 100 is positioned by the user near or adjacent to ear buds 30 and 40. The user then inserts audio input 50 into (an interior channel of) restraint 100, thus ear buds 30 and 40 and audio input 50 are tightly restrained by restraint 100. This creates a temporary and removable loop 75 in wires 10 and 20. For safety's sake and to reduce the possibility of choking, loop 75 should be released, i.e. input portion 50 removed from restraint 100, upon application of a separation force of less than 2 pounds, 1 kilo, 5 pounds, or the like. Different portions of audio input 50 may be restrained, e.g. a body portion, a plug portion, a wire portion, or the like; and different portions of ear buds 30 and 40 may be restrained, e.g. wires 10 or 20, a neck portion, a body portion, or the like.

In some examples, restraint 100 may be formed from a material having an arbitrary outside shape and a circular, cylindrical, prismatic, or other shaped interior channel. In various embodiments, the material may be a solid, such as a polymer, resin, plastic, PVC, pencil-eraser-type material, rubber, latex, metal, tubing, silicone, vinyl, Teflon, or the like. For example, a "Japanese"-type eraser could be adapted for embodiments of the present invention by drilling or forming a channel through such erasers. Additional examples of cross-sections of restraints are illustrated as restraints 66-68 relative to audio input 69. As can be envisioned, the interior cross-sectional shape may change when audio input 69 is inserted. The material of restraint provides an inward force within the channel, and the material thus provides an orthogonal frictional force with respect to ear buds 30 and 40 and to audio input 50. In some embodiments, this frictional force restrains the movement of ear buds 30 and 40 with respect to audio input 50 (e.g. keeps audio input 50 within the restraint). When the user removes audio input 50 from the channel, the interior protrusions shown and the interior shape typically flex back to their original positions. The interior protrusions and/or the cross-sectional shape of the channel may prevent restraint 100 from accidentally falling off the headphones when in configuration 15, i.e. prevents audio input 50 from easily passing through the channel of restraint 100.

In some embodiments, restraints, such as restraints 66 and 68 are manufactured and then slipped over audio input 69 so that the headphones are configuration 15. In other embodiments, restraints, such as restraints 66 and 68 are manufactured, wires 10 and 20 are threaded in the channels, and then ear buds 30 and 40 are connected to wires 10 and 20.

In another embodiment, restraint 67 may include two or more pieces of material that have an cross-section that is smaller than audio input 69. In some examples, one or more microphones 45 are located along wires leading to the ear buds of some headphones. Accordingly, the perimeter of the channel may be larger than microphone 45 so that restraint 100 can be easily positioned below microphone 45, i.e. out of the way, in configuration 15, but can be repositioned above microphone 45 to configuration 25. In light of the present disclosure, one of ordinary skill in the art will be able to imagine many other shapes and configurations that will be within the scope of embodiments of the present invention.

FIG. 1B illustrates additional embodiments of the present invention, e.g. headphone 60. More specifically, a retainer may be a coil 80, e.g. a metal spring, a plastic spring, a plastic coated metal spring, or the like. In other embodiments, other cross-sectional shapes for the coil may be used, such as square, star, or the like. As shown, as the audio input is inserted into coil 80, the diameter (interior channel, interior perimeter) of coil 80 expands to adapt to the audio input. Coil 80 thus applies a restraining pressure onto the wires and to the audio input. In such examples, the wires 10 and 20 may be wound through coil 80, or wires 10 and 20 may be inserted through coil 80 before the ear buds are attached.

In other embodiments, an open cylinder or tube 90 of pliable material is used as a restraint. When audio input device is inserted inside cylinder 90, the interior channel of cylinder 90 may expand in size and restrain the movement of the ear buds and the audio input device. In various embodiments, cylinder 90 may be made of plastic, silicone, metal, or the like, and the channel may be closed (e.g. restraint 100), or open (e.g. restraint 90).

Figure 2A:
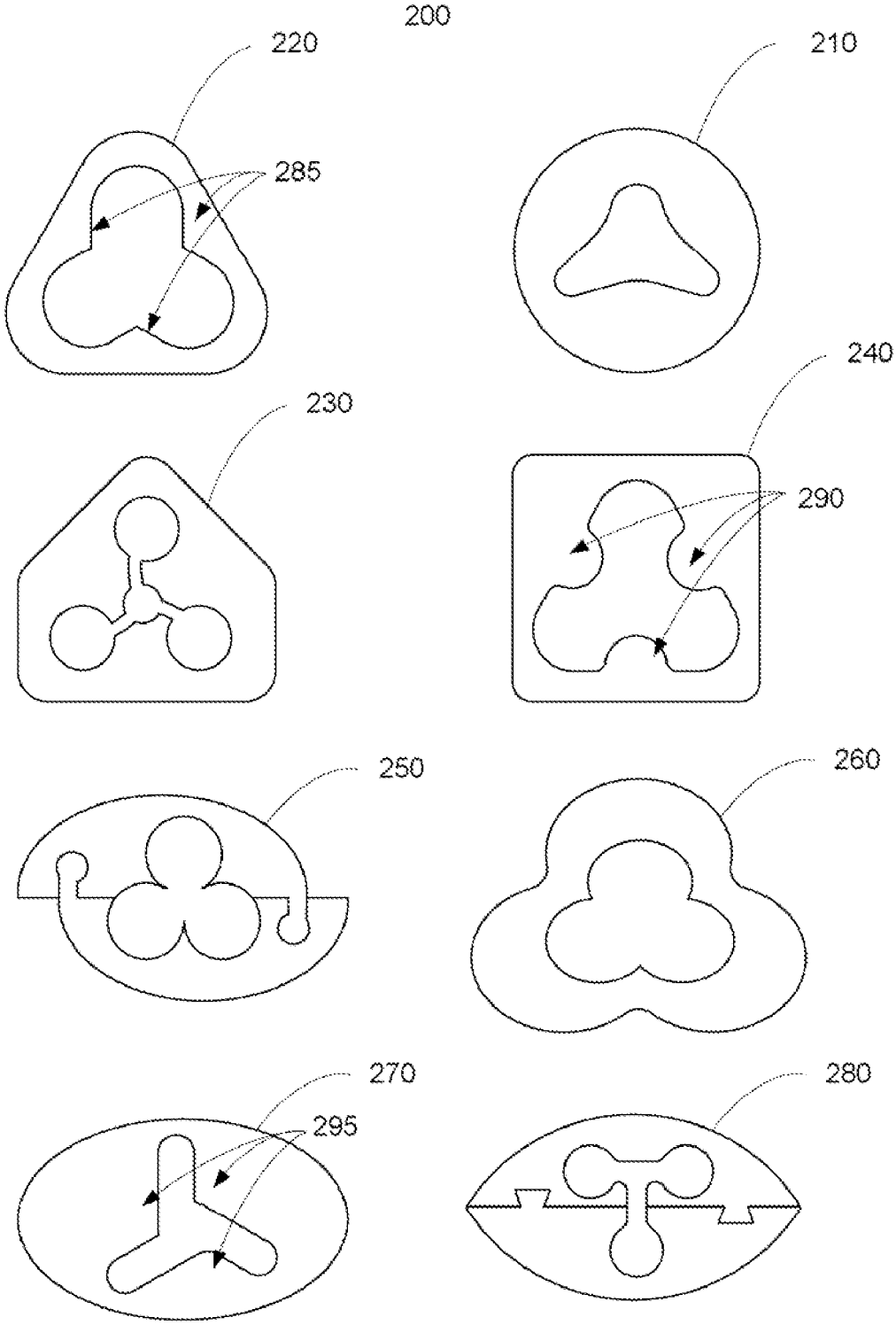
FIGS. 2A-B illustrate various embodiments of cross-sections of restraints to be used in conjunction with earphones/ear buds.
Figure 2B:
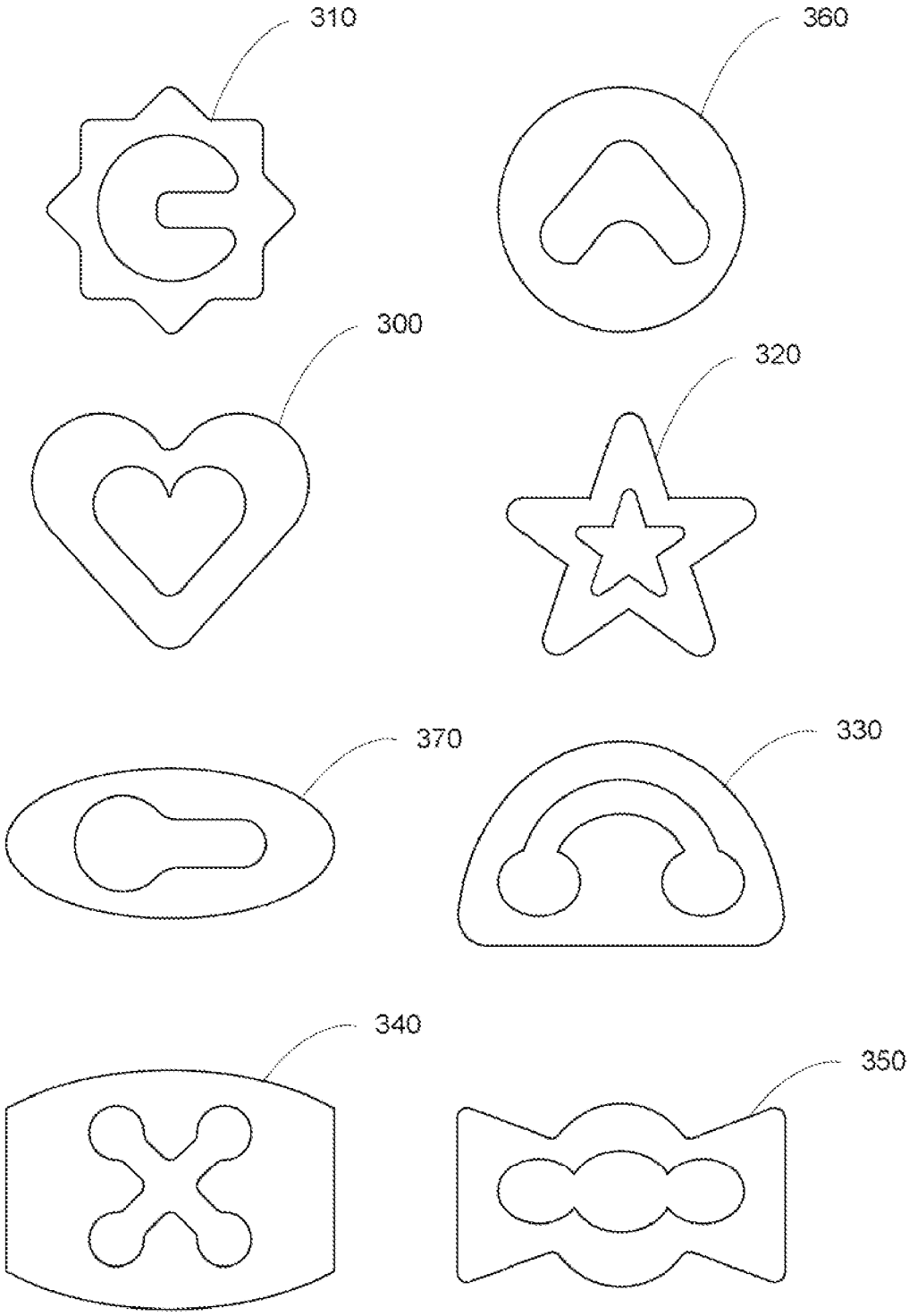

FIGS. 2A-B illustrate various embodiments of cross-sections of restraints to be used in conjunction with earphones/ear buds. As can be seen, in FIG. 2A, the restraint devices 200 may have different external (cross-section) shapes and/or different interior (interior channel) (cross-section) shapes. For example, the external shape may be approximately circular 210, triangular 220, polygonal 230, square 240, asymmetrically-shaped 250, lobed 260, oval 270, football, or the like. Other examples of restraint devices 300 are seen, in FIG. 2B, where the external shapes may be approximately, heart-shaped 300, star shaped 310 and 320, D-shaped (any letter shape) 330, barrel-shaped 340, fanciful (e.g. bow-tie, candy shaped) 350, or the like. In various embodiments, restraint devices may be made of two or more portions, such as restraints 250 and 280.

Additionally, the restraint devices may have different interior channel cross-section shapes. In the examples in FIG. 2A, a number of protrusions into the interior channel are shown, that give the channel the cross-section a concave portion. More specifically, channels having three-protrusions are shown. For example, protrusions 285, 290 and 295 are noted in FIG. 2A. In the examples in FIG. 2B, for restraints 300, 310, and 360, a channel having a single protrusion are shown; for restraints 370 and 330, a channel having two protrusions are shown; for restraints 340 and 350, a channel having four protrusions is shown; and for restraint 320, a channel having five protrusions are shown; and for restraint 100 (FIG. 1), a channel having no protrusions is shown. In light of the above, it can be seen that a restraint may have any number of protrusions or not protrusions.

Figure 3:
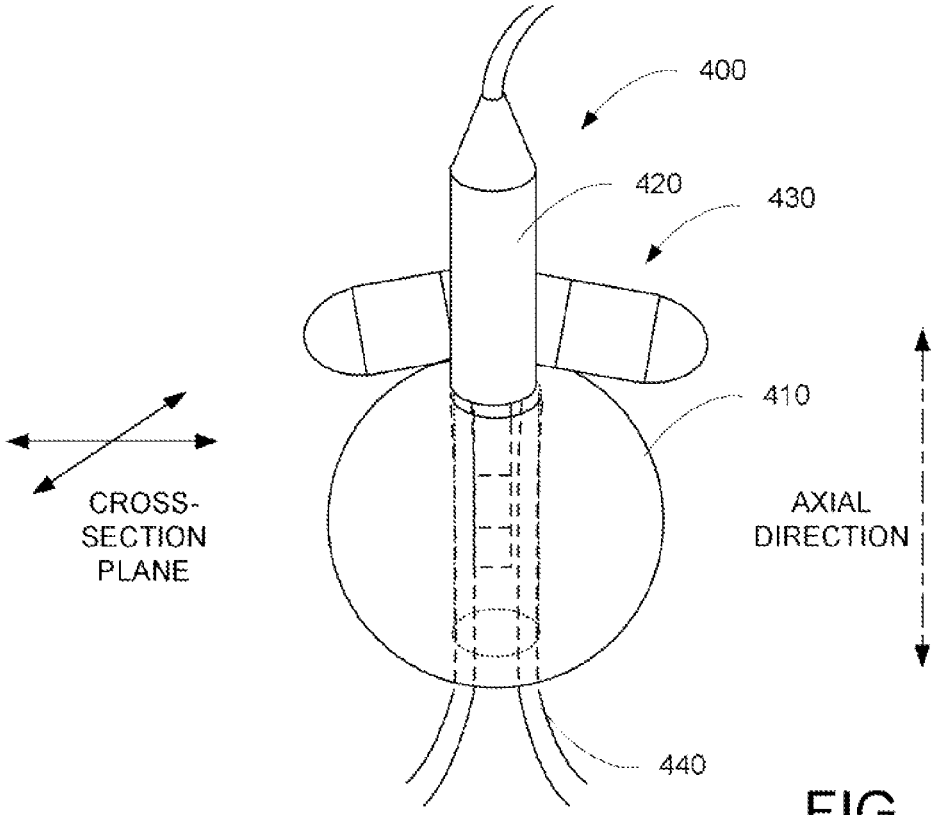
FIGS. 3, 4A-B, 5A-B and 6A-B illustrate embodiments of the present invention.

FIG. 3 illustrates various embodiments of the present invention. More specifically, FIG. 3 is a perspective view of a headphone 400 having a restraint 410, when plug 420 and ear buds 430 are restrained by restraint 410. Restraint 410 may have an arbitrary three dimensional shape, such as a sphere. In other embodiments, the external 3D shape may be any desired shape, such as golf-ball-shaped, a company logo shape, a cube-like shape, a cone-like shape, a prism, a star-like shape, a animal shape, a humanoid shape, or the like.

Figure 4A:
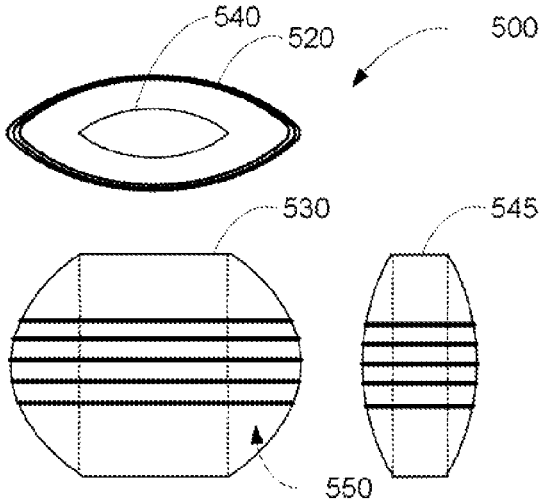
Figure 4B:
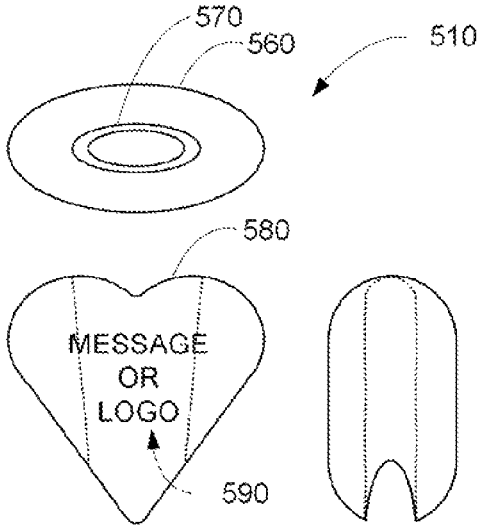

FIGS. 4A-B illustrate additional embodiments of the present invention, such as a top, front, and side views of restraint 500 and 510. In FIG. 4A, top view 520 of restraint 500 illustrates a cross-sectional view of restraint 500 including channel 540 similar to those in FIGS. 2A-B, and front view 530 and side view 545 illustrate shapes of restraint 500 in the axial direction. As can be seen in the views, restraint 500 may include a number of ridges 550 that provide additional grip to the user when using restraint 500.

In FIG. 4B, a top view 560 of restraint 510 including channel 570 is also similar to a cross-sectional view. In front view 580, region 590 may include any number of surface designs, text (e.g. names), patterns, pictures (e.g. smiley face, poke ball, baseball, basketball), textures, symbols (e.g. peace, ying-yang), corporate logos or names (e.g. providers of headphones that may include restraint mechanisms and be embodiments of the present invention: Apple, Bose, Sony, Monster, Audio-Technica, Shure, Yamaha, Denon, Sennheiser, Klipsch, Ultrasone, Grado, Ultimate Ears, JBuds, Koss, Westone, Etymotic Research, Sleek Audio, Jays, Skullcandy, JH Audio), customizing, or the like, may be applied to the surface of restraint 510. Such surface designs may be applied to virtually all contemplated restraints.

In front view 580, it can be seen that channel 570 may be tapered along the axial direction. In various embodiments, the tapering may help restraint 510 restrain an audio input and ear buds to a higher degree. Additional examples are illustrated below. In light of the above disclosure, one of ordinary skill in the art will be able to imagine any number of additional shapes that are within the scope of the present patent application disclosure.

Figure 5A:
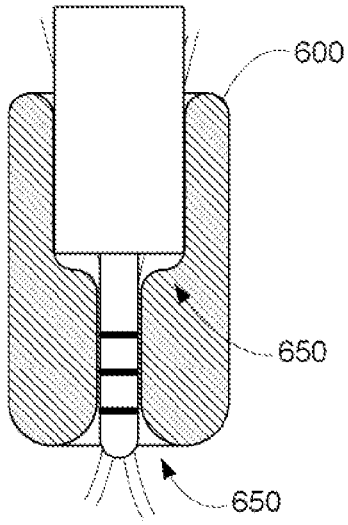
Figure 5B:
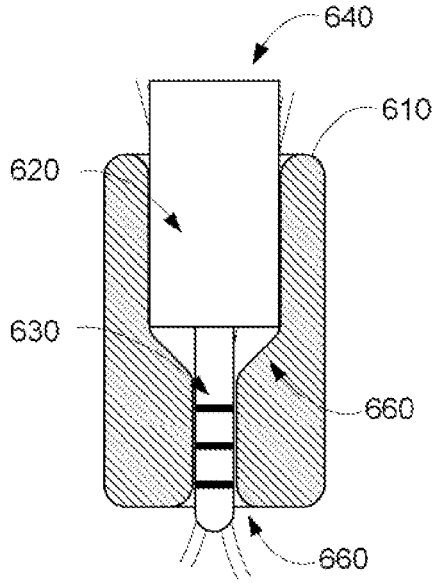

FIGS. 5A-B illustrate additional embodiments of the present invention. In FIGS. 5A-B, restraints 600 and 610 illustrate examples where the size or shapes of channels 650 and 660 are configured to restrain a casing portion 620 and a metal portion 630 of an audio plug 640. As illustrated, a transition between these portions may be stepped 670, ramped 680, or the like. These embodiments may provide a higher restraint force upon audio plug 640.

Figure 6A:
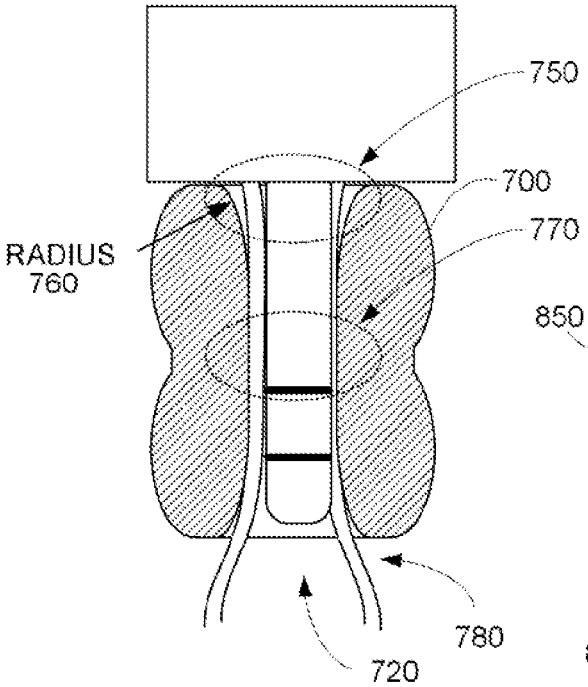
Figure 6B:
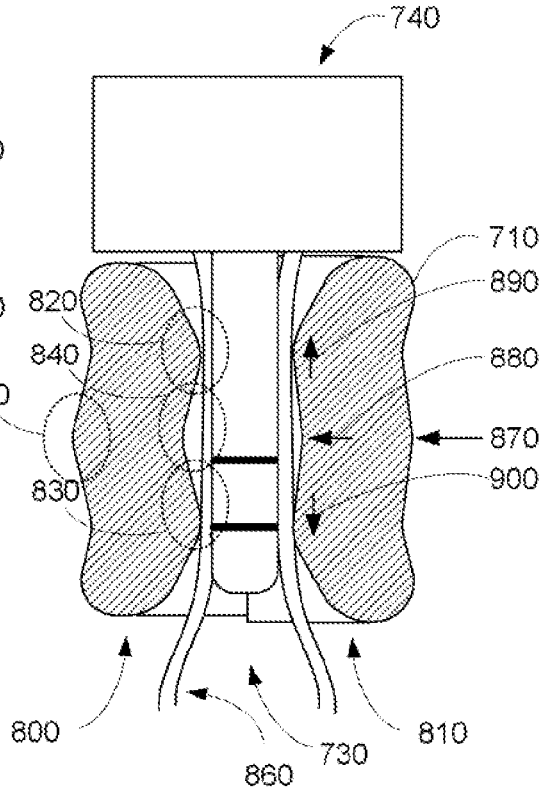

FIGS. 6A-B illustrate additional embodiments of the present invention. In FIGS. 6A-B, restraints 700 and 710 illustrate embodiments where the size or shapes of interior channels 720 and 730 are configured to restrain a portion (e.g. casing portion, metallic portion, strain relief) of an audio plug 740. As illustrated in FIG. 6A, in restraint 700, the size of channel opening 750 is larger than a size of channel 720 within region 770. By increasing the size and increasing a rounding radius or curvature 760, restraint 700 may reduce the stress to headphone wires 780 that are restrained by restraint 700. A portion where restraint 700 contacts audio plug 740 within region 770 may be approximately 0.25 inch, 0.5 inch, 1 cm, etc.

FIG. 6B illustrates a first configuration 800 a second configuration 810 of restraint 710. As can be seen in first configuration 800, restraint 710 may include two or more protrusions in regions 820 and 830 separated by a gap region 840, and an external protrusion 850. Protrusions in regions 820 and 830 are configured to restrain headphone wires 860 and audio plug 740, as described above. A distance between protrusions where restraint 710 contacts audio plug 740 may be separated by approximately 0.25 inch, 0.5 inch, 1 cm, etc.

In second configuration 810, when a user pushes or squeezes 870 restraint 710 around protrusion 850, as shown, gap region 840 is reduced 880 and the protrusions in regions 820 and 830 tend to move away 890, 900 from gap region 840. Depending upon specific design of the protrusion, in configuration 810, the contact area between the protrusions and the headphone wires 860 and audio plug 740 may increase. In various embodiments, the material of restraint 710 that contacts audio plug 740 in configuration 810 may have a lower sliding friction. Depending upon the materials used, the sliding friction between the audio plug 740 and the interior channel 730 may thus decrease in configuration 810. Accordingly, when the user pushes or squeezes 870 restraint 710, the amount of effort to remove audio plug 740 from or insert audio plug 740 into interior channel 730 may be advantageously reduced.

In operation, a user listens to audio signals from an audio source using headphones. The audio source may be any conventional electrical audio output device, such as a computer, a portable media device (e.g. Apple iPad, Amazon Kindle), a mobile telephone (e.g. iPhone), or the like. In various embodiments, headphones may be embodied as in-ear ear buds, over the ear headphones, or the like. Next, the user removes the ear buds from their ears and the user removes the electrical input portion or connector from the audio source. Next, the user slides the restraint (over the microphone, if present) and positions the restraint element approximately adjacent to the ear buds. Next, while the user holds the restraint device, the user then physically couples the restraint device to the input portion (e.g. inserts the input portion into the interior channel of the restraint device). Different portions of the audio input may be restrained, such as the metal plug, the casing, the wire, or the like. Depending upon specific configuration of the restraint device, the movement of the input portion is somewhat restrained relative to the ear buds, and/or the ear buds are restrained with respect to each other. In various embodiments, the user may then store the earphones in any desired manner, such as, the user winding the earphones (having the temporary loop) around the audio output device; the user winding the earphones (with temporary loop) around their hand and then placing the earphones in a pouch, pocket, the user stuffing the earphones into their pocket, or the like; the user placing the temporary loop (carefully) over their head; or the like. In various embodiments, the earphones are then said to be in a stored state.

Later, the user may wish to use their headphones. Initially, the earphones are stored in the stored state (e.g. including the temporary loop of wire). Next, the user visually identifies the location of the electrical input connector or portion, the restraint device, and/or the ear buds. Because restraint device restrains the input portion relative to the ear buds, it is expected that the user may easily identify one or more of these elements from the tangled mass of wires. Then, the user grasps the input portion with one hand and the restraint device with their other hand, and pulls her hands apart to separate the input portion from the restraint device. Surprisingly, in various embodiments, many if not most of the apparent tangles in the tangled mass of wires surprisingly disappear while separating the input portion from the ear buds. As can be seen in the experimental data provided within the present disclosure, the amount of time it takes to detangle earphones stored as described herein is substantially shorter than without the temporary loop of wire. The user may use the headphones.

The inventors have confirmed the effectiveness in reducing the tangling tendency of various embodiments of the present invention. More specifically, a headphone A was repeatedly tangled and the amount of time to untangle the headphones was recorded. For headphone A, the untangling time was recorded without using a restraint device and using the restraint device. After 20 trials were run, without the restraint, the average untangling time was 15.2 seconds, with a standard deviation of 7.5 seconds. After 20 trails were run, using the restraint, the average untangling time was 7.7 seconds with a standard deviation of 3.4 seconds. Thus on average, the amount of time to untangle headphone A was reduced by about 50% and the standard deviation was also reduced by about 50%. For a headphone B, after 20 trials were run, without the restraint, the average untangling time was 18.1 seconds, with a standard deviation of 7.5 seconds. Then after 20 trails were run, using the restraint, the average untangling time was 5.3 seconds with a standard deviation of 3.2 seconds. Thus on average, the amount of time to untangle headphone B was reduced by about 72% and the standard deviation was also reduced by about 57%.

In light of the trial data obtained by the inventors, it is believed that headphones configured according to embodiments of the present invention are very effective in reducing the amount of tangling of the wires when the headphones are stored. As a result, users of such headphones will be able to untangle their headphones more quickly and efficiently.

In various embodiments of the present invention, the term "somewhat" is used to refer to the restraint of movement of input portion and the output portions once a the input portion is restrained within the restraint device and the temporary loop of wire is formed by the user. In some embodiments, the movement restraint may be high such that if a user pulled upon the input portion and the output portion, the restraint element does not appreciably move along the wires connected to the output portions, and/or the temporary loop of wire is maintained. In various embodiments, the amount of movement may be less than one-eighth and inch or less, three mm or less, or the like, until a high force is applied.

Further embodiments can be envisioned to one of ordinary skill in the art after reading this disclosure. In other embodiments, combinations or sub-combinations of the above disclosed invention can be advantageously made. The block diagrams of the architecture and flow charts are grouped for ease of understanding. However it should be understood that combinations of blocks, additions of new blocks, re-arrangement of blocks, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A headphone having reduced-tangling potential comprising:

an audio plug configured to receive electrical signals from an audio output device;

a pair of ear buds configured to receive electrical signals and to output audio output in response to the electrical signals;

a pair of coupling cables coupled to the audio plug and to the pair of ear buds, wherein the pair of coupling cables are configured to provide the electrical signals from the audio plug to at least the pair of ear buds; and a restraint device coupled to the pair of coupling cables, wherein the restraint device comprises a body comprising a pliable material, wherein the body includes a channel, wherein the pair of coupling cables are disposed within the channel, wherein the channel is configured to restrain movement of a first ear bud with respect to a second ear bud by a first resistance amount, when at least a portion of the audio plug is inserted into the channel, and wherein the channel is configured to restrain movement of the first ear bud with respect to the second ear bud by a second resistance amount, when the plug portion is separated from the channel, wherein the first resistance amount exceeds the second resistance amount.

2. The headphone of claim 1 wherein the audio plug is adjacent to the pair coupling cables within the channel when at least the portion of the audio plug is inserted into the channel, and wherein the channel is configured to restrain movement of the audio plug with respect to the first ear bud and to the second ear bud when at least the portion of the audio plug is inserted into the channel.

3. The headphone of claim 1 wherein the channel has a cross-section shape selected from a group consisting of: bi-lobed, tri-lobed, multi-lobed, C-shaped, H-shaped, L-shaped, N-shaped, O-shaped, S-shaped, T-shaped, U-shaped, V-shaped, X-shaped, Y-shaped, triangular-like, polygonal-like, star-shaped, ovoid, round, square-like, asymmetric, and wherein the body portion has a body cross-section shape that is different from a channel cross-section shape of the channel.

4. The headphone of claim 1 wherein the channel has a cross-section shape including one or more concave portions, and wherein the body portion comprises two or more individual portions that are assembled together.

5. The headphone of claim 1 wherein a parameter of a cross-section of the channel changes in an axial direction within the body portion, and wherein the parameter of the cross-section of the channel is selected from a group consisting of: cross-sectional area, internal perimeter, size, width, length, shape, texture.

6. The headphone of claim 5 wherein a parameter of a cross-section of the body portion changes in an axial direction, and wherein the parameter of the cross-section of the body portion is selected from a group consisting of: cross-sectional area, perimeter, size, width, length, shape, texture, color.

7. The headphone of claim 1 further comprising:

an in-line microphone coupled to a coupling cable;

wherein the restraint device is configured to apply a third resistance amount to the in-line microphone, when the restraint device is moved over the in-line microphone, wherein the restraint device is configured to apply a fourth resistance amount to the audio plug, when the restraint device is moved over the audio plug, wherein the fourth resistance is greater than the third resistance.

8. The headphone of claim 7 wherein the pliable material is selected from a group consisting of: rubber, silicone, plastic, polymer, pencil eraser-material, vinyl, metal, resin, PVC, pencil eraser-type material, latex, metal, wire, tubing.

9. The headphone of claim 1 wherein the channel comprises:

an opening in an axial direction, where the opening is adapted to increase a bending radius of the pair of coupling cables, one or more channel protrusions along the axial direction, wherein the one or more channel protrusions are adapted to apply a third resistance amount to the audio plug when at least the portion of the audio plug is inserted into the channel.

10. The headphone of claim 9 wherein the one or more channel protrusions are adapted to apply a fourth resistance amount to the audio plug when at least the portion of the audio plug is inserted into the channel and when the body portion is deformed by a user.

11. A restraint device for a headphone comprising an input plug coupled to a first ear ear bud and to a second ear bud via a pair of headphone wires, the restraint device comprising:

a body comprising a pliable material, wherein the body includes an interior channel, wherein the interior channel is configured to have both the pair of headphone wires disposed therein, wherein the interior channel is configured to restrain movement of a first ear bud with respect to a second ear bud and to restrain movement of the first ear bud and second ear bud with respect to the input plug, when at least a portion of the input plug is inserted into the interior channel and when at least the portion of the input plug is adjacent to the pair of headphone wires.

12. The restraint device of claim 11 wherein the interior channel has a cross-section shape selected from a group consisting of: bi-lobed, tri-lobed, multi-lobed, alphanumeric shaped, triangular-like, polygonal-like, star-shaped, ovoid, round, square-like, asymmetric, and wherein the body portion has a body cross-section shape that is different from a channel cross-section shape of the channel.

13. The restraint device of claim 11 wherein the interior channel has a cross-section shape including one or more concave portions, and wherein the body portion comprises two or more individual portions that are assembled together.

14. The restraint device of claim 11 wherein a parameter of a cross-section of the interior channel changes along an axial direction within the body, and wherein the parameter of the cross-section of the interior channel is selected from a group consisting of: cross-sectional area, internal perimeter, size, width, length, shape, texture.

15. The restraint device of claim 11 wherein a parameter of a cross-section of the body changes along an axial direction, and wherein the parameter of the cross-section of the body portion is selected from a group consisting of: cross-sectional area, perimeter, size, width, length, shape, texture, color.

16. The restraint device claim 11 wherein the headphone includes an in-line microphone coupled to the pair of headphone wires;

wherein the interior channel is configured to apply a first resistance amount to the in-line microphone, when the in-line microphone is disposed within the interior channel, wherein the interior channel is configured to apply a second restraint amount to the input plug, when the input plug is disposed within the interior channel, wherein the second resistance is greater than the first resistance.

17. The restraint device of claim 16 wherein the pliable material is selected from a group consisting of: rubber, silicone, plastic, polymer, pencil eraser-material, vinyl, metal, resin, PVC, pencil eraser-type material, latex, metal, wire, tubing.

18. The restraint device of claim 11 wherein the body comprises:

an channel opening in an axial direction, where the opening is adapted to increase a bending diameter of the pair of headphone wires with respect to the restraint device, and one or more channel protrusions along the axial direction, wherein the one or more channel protrusions are adapted to apply a first resistance amount to the input plug when at least the portion of the input plug is inserted into the channel.

19. The restraint device of claim 18 wherein the one or more channel protrusions are adapted to apply a second resistance amount to the input plug when at least the portion of the input plug is inserted into the channel and when the body portion is deformed by a user.

20. The restraint device of claim 11 wherein the interior channel includes an opening in the axial direction, and wherein the opening in the axial direction is adapted to allow the pair of headphone wires to be disposed from a position outside the interior channel to a position within the interior channel.

21. The restraint device of claim 11 wherein the interior channel comprises a first channel portion and a second channel portion;

wherein the first channel portion is adapted to restrain a casing portion of the input plug;

wherein the second channel portion is adapted to restrain a metallic plug portion of the input plug;

wherein a cross-sectional size of the first channel portion is greater than a cross-sectional size of the second channel portion.

* * * * *